United States Patent [19]

O'Brian et al.

[11] 4,437,413

[45] Mar. 20, 1984

[54] FOLDING STRUCTURE EMPLOYING A SARRUS LINKAGE

[75] Inventors: Edward D. O'Brian, 2125 W. Falmouth, Anaheim, Calif. 92801; Charles Phelan, Tustin, Calif.

[73] Assignee: Edward D. O'Brian, Anaheim, Calif.

[21] Appl. No.: 300,060

[22] Filed: Sep. 8, 1981

[51] Int. Cl.[3] ..... A47B 3/00

[52] U.S. Cl. ..... 108/111; 108/129; 108/130; 182/33; 182/152

[58] Field of Search ..... 108/113, 112, 115, 123, 108/129, 130, 111; 182/152, 33, 35, 28; 248/171, 166

[56] References Cited

U.S. PATENT DOCUMENTS

| | | | |
|---|---|---|---|
| 2,879,120 | 3/1959 | Howe et al. | 108/113 |
| 3,259,426 | 7/1966 | Shaw et al. | 108/115 X |
| 4,046,084 | 9/1977 | Hosford et al. | 248/167 X |
| 4,102,555 | 7/1978 | Tobolski | 108/111 |
| 4,120,249 | 10/1978 | Blink et al. | 108/130 X |
| 4,318,353 | 3/1982 | Schier | 108/130 X |

FOREIGN PATENT DOCUMENTS

| | | | |
|---|---|---|---|
| 107981 | 2/1966 | Norway | 108/113 |

*Primary Examiner*—James T. McCall

*Attorney, Agent, or Firm*—Edward D. O'Brian; K. H. Boswell

[57] ABSTRACT

A Sarrus linkage is a type of folding linkage or structure in which two opposed links are connected by two sets of connecting links, each of which sets includes two separate links. The links of such a linkage are hinged together in such a manner that the entire linkage will fold and unfold as any part of the linkage is moved with respect to the remainder of the linkage. By providing a control link which is pivotally connected to one of the opposed links and a motion transmitting link pivotally connected to the control link and to one of the links of one of the sets, a folding structure can be obtained which can be employed for a variety of useful purposes. Best results are obtained when two of the motion transmitting links are employed, one of the motion transmitting links being pivotally connected between a link of one of the sets and the control link and the other of the motion transmitting means being connected between a link of the other of the sets and the control link.

13 Claims, 8 Drawing Figures

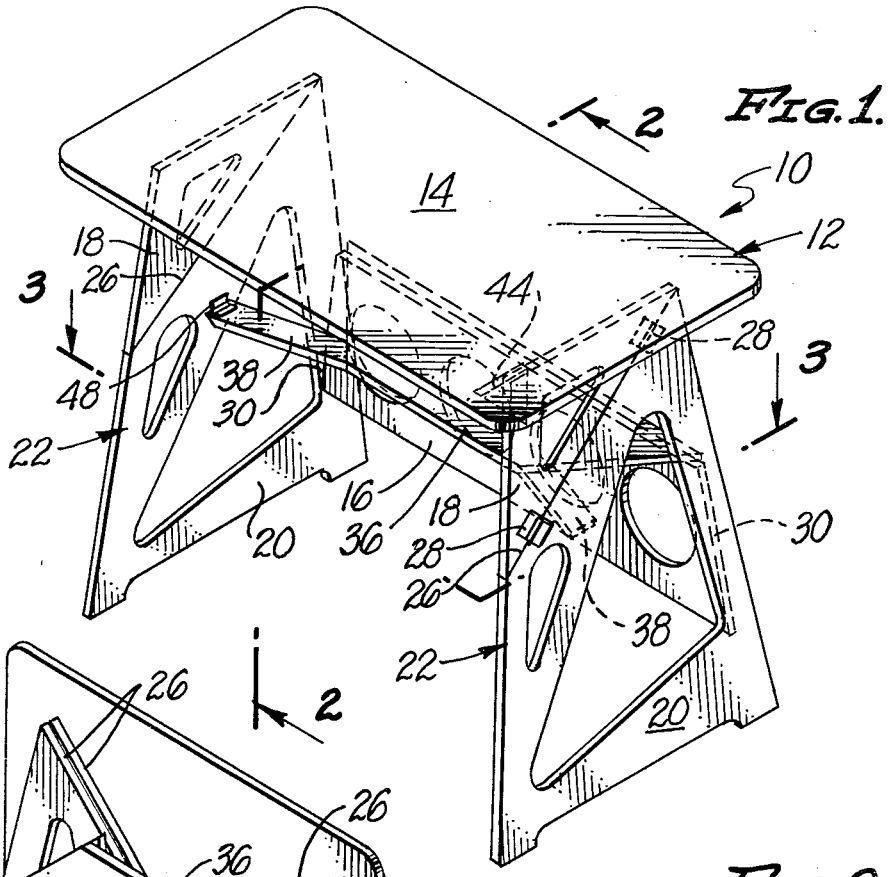
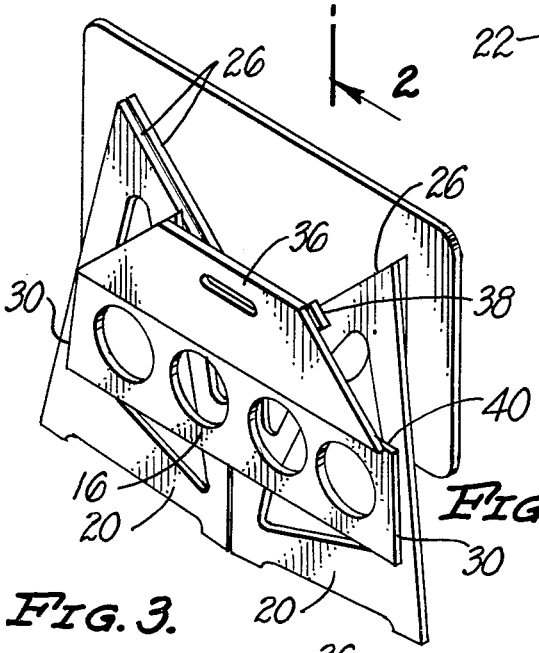
FIG. 4.
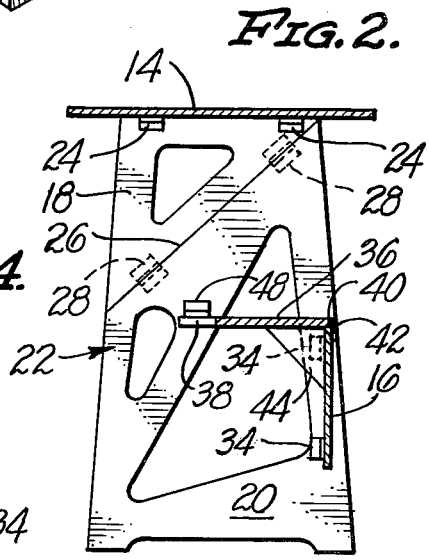
FIG. 3.
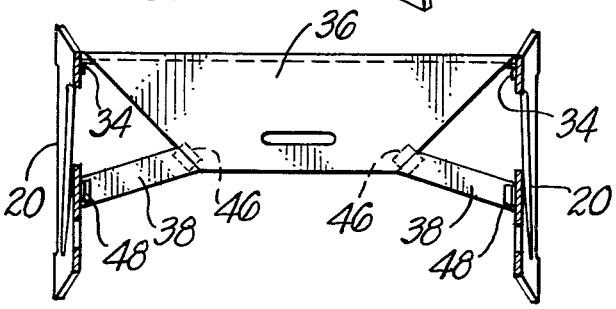

FIG. 5.
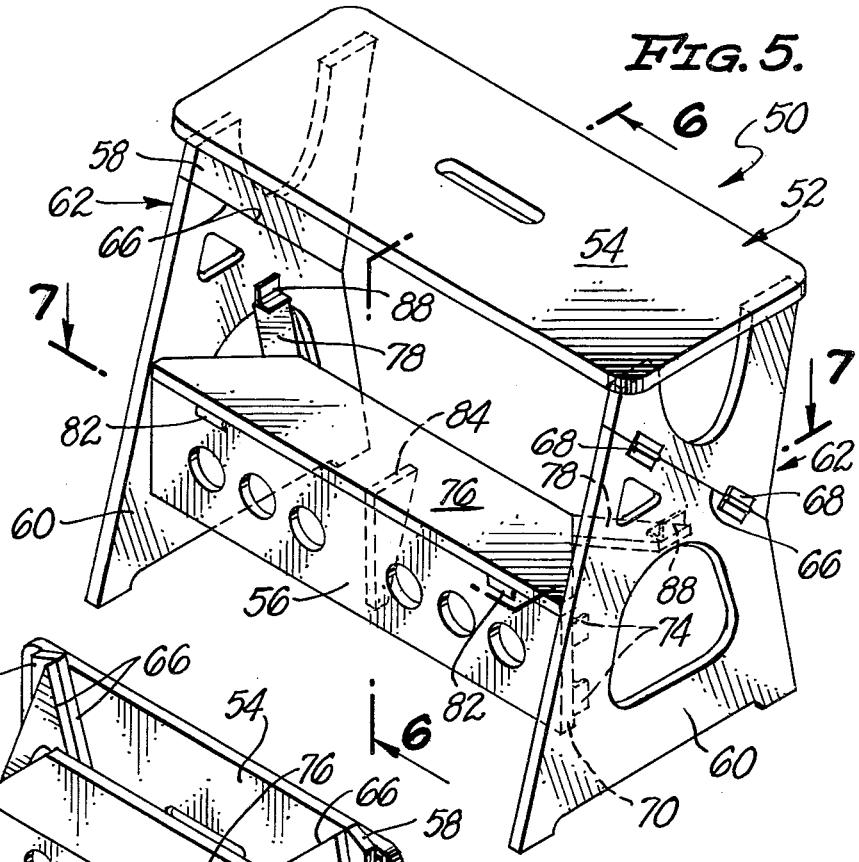
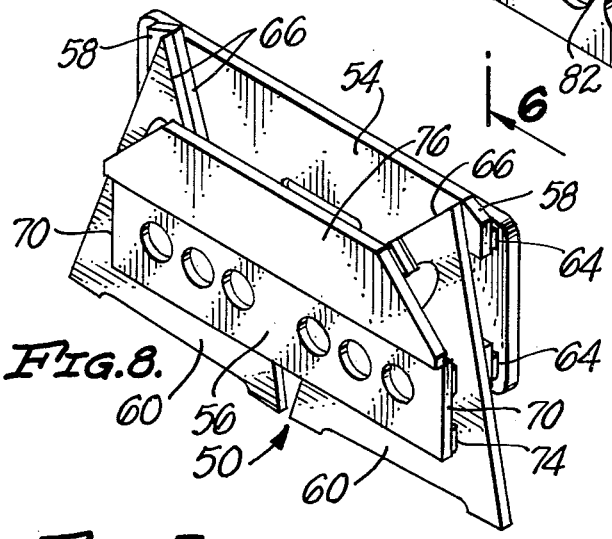
FIG. 8.
FIG. 6.
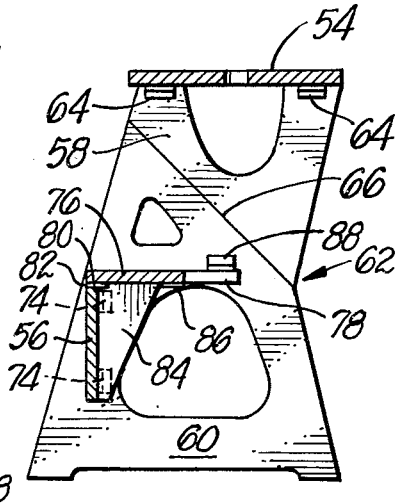
FIG. 7.
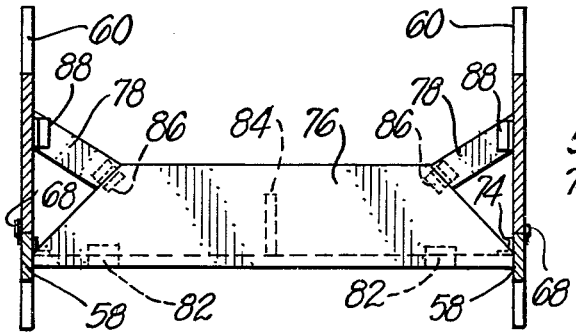

FOLDING STRUCTURE EMPLOYING A SARRUS LINKAGE

BACKGROUND OF THE INVENTION

This invention pertains to new and improved folding structures employing a Sarrus linkage. Such folding structures are considered to be capable of being constructed so as to have a wide variety of different useful purposes.

A Sarrus linkage, or a linkage employing Sarrus motion, is a type of a folding structure in which two opposed links are connected by two different sets of connecting links, each of these sets including two separate links. The sets of connecting links are spaced from one another. In such a linkage the connecting links of each of the sets are located in edge to edge relationship and have adjacent edges which are hingedly connected to one another. The edges of the connecting links remote from the connected adjacent edges are hingedly connected to the opposed links.

Normally in a Sarrus linkage the opposed links and the connecting links are constructed so that the opposed links are parallel to one another and will move in parallel planes as any part of the Sarrus linkage is moved with respect to the remainder of the linkage. The opposed links, however, need not move in parallel planes in a Sarrus linkage. Such a linkage can be constructed so that as it is operated the opposed links move generally toward and away from one another about an axis in a manner which can be compared to the way that the pages of a book move as they are turned.

It is considered that it is now reasonably established that a wide variety of different utilitarian folding structures can be created utilizing a Sarrus linkage. It is not considered that an understanding of the invention requires a detailed discussion of such structures. It is considered, however, that many such prior utilitarian structures employing a Sarrus linkage are relatively disadvantageous in some specific applications because of the problems and complications involved in manipulating the linkage between a generally expanded, open or unfolded configuration and a generally compact or folded configuration. While such relative motion can be created by physically engaging a single part of a Sarrus linkage and moving that part relative to the remainder of the linkage, in certain applications this type of construction is relatively disadvantageous.

As a result of the preceding consideration it is considered that there is a need for new and improved folding structures employing a Sarrus linkage. It is considered that this need is particularly significant in connection with the construction of folding structures such as step stool or saw horse type structures, folding tables or benches and the like. It will be recognized that a wide variety of different types of folding step stools, folding tables, benches and related structures have been known and used and have proven to be very satisfactory and practical. It is not considered necessary to discuss these prior folding structures. It is believed that many such structures have been relatively undesirable in one or more regards because they have not utilized a linkage in an effective manner so as to achieve a comparatively simple type structure capable of being easily and conveniently constructed having advantageous physical folding characteristics.

BRIEF SUMMARY OF THE INVENTION

This invention is intended to provide new and improved folding structures employing or including a Sarrus linkage. It is also intended to provide folding structures which include or are based on such a linkage which may be easily and conveniently constructed at a comparatively nominal cost, which may be easily and conveniently manipulated between an expanded, unfolded or open configuration and a compact or folded configuration, which are advantageous because of their physical characteristics, and which can, depending upon details of construction, be used for a variety of different, useful purposes.

In its more specific aspects, the invention is intended to provide new and improved folding step stool or saw horse type structures which can be utilized for a number of different purposes and folding tables or work benches. Both the new folding step stool-saw horse type structures of the present invention and the folding table or benches of the invention are considered to be particularly desirable because of the fact that they may be easily manipulated between opened and closed positions with a minimum of difficulty and because when these structures are in an opened or unfolded configuration they will normally be of such a character as to have desirable physical characteristics—primarily strength characteristics.

In accordance with this invention the preceding "objectives" are achieved by providing a folding structure including a six member Sarrus linkage having two opposed links and two sets of connecting links, each of said sets including two separate links, the connecting links of each of said sets having adjacent edges hingedly connected to one another, a first connecting link of each of said sets being hingedly connected to a first of said opposed links, the second connecting link of each of said sets being hingedly connected to the second of said opposed links, said sets of connecting links being spaced from one another, in which the improvement comprises: a control link means pivotally connected to said first of said opposed links, a motion transmitting link means pivotally connected to said control link means and to a connecting link of one of said sets of connecting links, said control link means and said motion transmitting link means being connected to one another and to said Sarrus linkage so that said control link means be pivoted relative to said one of said opposed links and so that such motion of said control link means will be transmitted in order to cause relative movement between said opposed links so as to move said opposed links toward one another as said structure is being folded and so as to move said opposed links away from one another as said structure is being unfolded.

BRIEF DESCRIPTION OF THE DRAWINGS

Because of the nature of this invention it is considered that it is best more fully described with reference to the accompanying drawings in which:

FIG. 1 is an isometric view of a presently preferred embodiment or form of a table or bench in accordance with this invention in an open or unfolded configuration, this view showing the front, the top and an end of the table;

FIG. 2 is a cross-sectional view taken at line 2—2 of FIG. 1;

FIG. 3 is a cross-sectional view taken at line 3—3 of FIG. 1;

FIG. 4 is an isometric view of the table shown in FIG. 1 in a folded or collapsed position or configuration;

FIG. 5 is an isometric view of a presently preferred embodiment or form of a step stool or saw horse in accordance with this invention in an open or unfolded configuration or position, this view showing the front, the top and an end of the structure;

FIG. 6 is a cross-sectional view taken at line 6—6 of FIG. 5;

FIG. 7 is a cross-sectional view taken at line 7—7 of FIG. 5; and

FIG. 8 is an isometric view of the structure shown in FIG. 5 in a folded or collapsed configuration or position.

It is not to be assumed from the accompanying drawings that the invention is applicable only to the specific structures as are illustrated. Through the use of routine skill the broad concepts of this invention set forth and defined in the appended claims can be utilized in a variety of differently appearing and somewhat differently constructed structures through the use or exercise of routine engineering skill on the basis of the disclosure embodied within this specification. Thus, the present invention can be applied in constructing a variety of different horse, table, bench or similar structures used for a variety of different specific purposes.

DETAILED DESCRIPTION

In FIGS. 1 to 4 of the drawings there is shown a folding table or bench structure 10 of the present invention which is adapted to be utilized for a wide variety of different utilitarian purposes. This table 10 is constructed as is subsequently described so that it is adapted to be manually manipulated between an open or unfolded configuration as indicated in FIG. 1 of the drawings and a folded or collapsed configuration as indicated in FIG. 4.

This table 10 employs a Sarrus linkage 12 which includes a flat top 14, a vertically oriented beam-like brace 16, two end links 18 and two end links 20. In the linkage 12 the top 14 and the brace 16 may be considered as opposed links connected by sets 22 of links 18 and 20. Each of these sets 22 consists of one of the links 18 and one of the links 20 and in effect serves as a leg-like end for the table 10 since the links 18 and 20 of the sets are in the same plane when the table 10 is unfolded.

In the linkage 12 the top 14 is connected to the two links 18 by hinges 24 in such a manner that the end links 18 can swing from an open position generally toward one another and the top 14 as the structure 10 is being folded. In the linkage 12 adjacent edges 26 on the links 18 are connected through the use of other hinges 28. These other hinges 28 are oriented so as to permit folding of the links 20 relative to the links 18 so that each link 20 generally lies along a link 18 and extends parallel to the top 14 when the table 10 is in a folded configuration. The brace 16 has ends 30 which are connected to end links 20 through further hinges 34 so as to permit the brace 16 to extend generally parallel to the top 14 when the table 10 is in a folded configuration or position.

It is not considered necessary to encumber this specification with a further discussion relative to the specific Sarrus linkage 12 shown. Those skilled in the art or field of the mathematics of Sarrus motion will recognize that the hinges 24, 28 and 34 at or adjacent to each of the sets 22 have axes (not shown) which meet at a common point and that this is necessary in order to achieve a folding action which characterizes the linkage 12.

In accordance with the present invention this linkage 12 is modified so as to include an elongated flat shelf 36 serving as a control link and two different motion transmitting links 38. This shelf 36 is connected to an upper edge 40 of the brace 16 by hinges 42 in such a manner that the shelf 36 in an open configuration as shown in FIG. 1 will rest against the brace 16 so as to a degree be supported by this brace 16. If desired, a small bracket 44 may be located on the brace 16 so as to assist in supporting the shelf 36 in an open position.

The hinges 42 permit this shelf 36 to be pivoted about an axis (not shown) extending generally along the length of the brace 16 to a vertically oriented position. The motion transmitting links 38 are connected to this shelf 36 by means of hinges 46 and to the end links 20 by means of other hinges 48 in such a manner as to tend to pull the end links 20 generally toward one another when the shelf 36 is manipulated from a position in which it is shown in FIG. 1 to the position in which it is shown in FIG. 4. This has the effect of causing relative motion between the links 18 and 20 of the sets 22 so as to cause movement of these links 18 and 20 from a position as shown in FIG. 1 to a position as shown in FIG. 4 as the shelf 36 is pivoted.

The various actions which occur as a consequence of this pivoting of the shelf 36 relative to the brace 16 makes it possible for a single motion—the motion of the shelf 36 relative to the brace 16—to be utilized in manipulating the table 10 and more specifically the Sarrus linkage 12 in this table 10 from an open or unfolded configuration to a folded configuration with a minimum amount of difficulty. Unfolding from a folded position may easily be accomplished by a reverse of the motions indicated in the preceding. Although this can be achieved by merely applying a force to the shelf 36 to rotate the shelf relative to the brace 16 it is considered to be normally preferable to manipulate the table 10 from a folded to an unfolded configuration by lifting the top 14 relative to the brace 16 with a pivoting type of action which is regulated by the manner in which various parts are connected.

It will be noted that the table 10 utilizes two of the motion transmitting links 38 in such a manner that one of these links 38 couples motion of the shelf 36 to one of the sets 22 while the other couples motion of the shelf 36 to the other of these sets 22. Because of the inherent nature of any Sarrus linkage, such as the linkage 12, in theory only one of these motion transmitting links 38 need be employed with the table 10. However, because of the inherent nature of hinge joints and materials such as wood which are apt to be utilized in constructing the table 10 it is considered that as a practical matter satisfactory operation can only be achieved when two of the motion transmitting links 38 are employed so as to concurrently couple motion of the shelf 36 to each of the sets 22.

These motion transmitting links 38 can be connected to the links 18 and 20 in several different ways. As will be apparent from the preceding, their prime function relates to moving the links 18 and 20 so that they fold relative to one another as described. In effect, these links 18 and 20 are primarily intended to apply forces between the sets 22 and the shelf 36 such as to cause motion of the edges 26. As a result these links 38 should be located with respect to the sets 22 so as to accomplish this function. In some applications this may make it desirable to use the links 38 to couple the links 18 to the shelf 36 instead of using them to connect the links 20 to the shelf 36 as shown.

It is noted that in the table 10 the top 14, the links 18 and 20, the brace 16, and the shelf 36 cannot move past an open position corresponding to that shown in FIG. 1 in being manipulated from a folded configuration as shown in FIG. 4 because of the thicknesses of the parts noted and the manners in which they abut when in an open configuration. The links 38 may be proportioned so as to achieve what may be referred to as an "overcenter toggle" action tending to "lock" the entire table 10 in an open position inasmuch as some material deformation of a temporary character will be required to manipulate the table 10 into or out of a completely open configuration. It is not considered that this is particularly advantageous in connection with a table.

In FIGS. 5 to 8 of the drawings there is shown a folding structure 50 which is adapted to be utilized for a wide variety of different diverse purposes. Because of the manner in which this structure 50 is constructed it is considered to be particularly useful as a form of a stool. It is also desirable for use as a form of a platform which can be used for construction purposes in gaining access to shelves or the like. It is considered to be particularly desirable for use as a saw horse. This structure 50 is constructed as indicated in this specification so as to be capable of being manipulated between an open or unfolded configuration or position as indicated in FIG. 5 and a folded or collapsed configuration or position as indicated in FIG. 8.

This structure 50 employs a Sarrus linkage 52 which includes a flat top 54, a vertically oriented beam-like brace 56, two upper end links 58 and two lower end links 60. In this linkage 52 the top 54 and the brace 56 may be considered as opposed links which are connected by two sets 62 of links 58 and 60. In effect each of these sets 62 serves as a leg-like end for the structure 50 since the sets 62 lie in a plane when the structure 50 is unfolded. In the structure 50 the linkage 52 is constructed in such a manner that the top 54 is connected to the links 58 by means of hinges 64 as illustrated so that the links 58 can pivot about a common axis (not shown) of the hinges 64 generally toward one another and along the top 54. Each link 58 is connected to a link 60 along common edges 66 by means of other hinges 68. These other hinges 68 permit the links 60 to extend generally parallel to the top 54 and the links 58 when the structure 50 is in a folded configuration or position.

In the linkage 52 ends 70 of the brace 56 are connected by other hinges 74 to the links 60. These hinges 74 are oriented and the brace 56 is of such a length that the brace 56 will extend generally parallel to the top 54 when the structure 50 is in a folded configuration or position as illustrated in FIG. 8. It will be recognized from the preceding description that the various different hinges 64, 68 and 74 associated with each of the sets 62 have to be oriented so as to have axes (not shown) which meet at a common point. This is an important facet of the structure 50 since it relates to the structure described functioning so as to achieve Sarrus motion.

In accordance with the present invention the linkage 52 is modified so as to add to the conventional Sarrus linkage an elongated, flat step 76 which serves as a control link and, in addition, two different, separate motion transmitting links 78. This step 76 is connected to an upper edge 80 of the brace 56 by means of other hinges 82 as shown. With the specific structure illustrated the hinges 82 are generally between the upper end 40 and the step 76 when the structure 50 is in an open or unfolded position as illustrated in FIG. 1, and in addition, these hinges 82 hold the step 76 so that it rests against the brace 56 in such a manner as to extend horizontally in this open position. If desired, a small bracket 84 may be located on the brace 56 so as to help support the step 76 in this manner.

Each of the motion transmitting links 38 is connected to the step 76 by a hinge 86 and is connected to one of the end links 60 by a further hinge 88. The orientation of these hinges 86 and 88 is quite important. They must be oriented relative to the axes of the hinges 82 in such a manner as to permit rotation of the step 76 to be transmitted to the end links 60 in manipulating the structure 50 between open and closed positions. As the structure is being manipulated from an open position to a closed or collapsed position, these links 78 will pull on the links 60 so as to tend to pull the edges 66 on the sets 62 toward one another. In order to open the structure 50 it is preferable to manipulate the top 54 relative to the brace 56. This results in a series of coordinated movements which are the reverse of those described leading to the structure becoming opened.

The structure 50 is of such a nature that it is theoretically possible to dispense with one of the motion transmitting links 78. Because of the inherent nature of hinge joints and because of the inherent nature of materials such as are apt to be utilized in manufacturing the structure 50, it is preferable to utilize two of these links 78 in order to obtain a satisfactory, "smooth" operation. By minor variations in the geometry used, it is possible to modify the structure 50 so that the links 78 connect the step 76 and the end links 58 instead of the end links 60. In any such modification the important consideration is to obtain a structure in which relative rotation of the step 76 with respect to the brace 56 will cause coordinated motion of parts as indicated in the preceding discussion and in addition, to obtain a structure which will easily fold to a relatively flat configuration.

The structure 50 can be further modified in quite a number of different ways. The amount that the top 54 extends laterally outward from the links 58 when the structure 50 is unfolded or open is considered to be significant in connection with the utility of the structure 50 as a saw horse or similar type item of equipment. It is possible to proportion the various parts of the structure 50 described in such a manner that the links 78 can be moved to what may be referred to as an overcenter toggle type position as a result of some temporary material deformation. This type of feature will serve to "lock" the structure 50 against folding when it is in an open position and may be desirable in some presently unforeseen applications. Normally no problem will be encountered in connection with the structure 50 accidentally unfolding.

It will be apparent from the preceding that both the table 10 and the structure 50 are quite similar to one another, even though they are distinctly different as to their intended utilizations. Both the table 10 and the structure 50 are sufficiently similar that substantially all details with respect to them other than details related to their intended applications are so closely related that in a sense it seems unnecessary to describe them both. They are both set forth in this specfication so as to effectively indicate the breadth and scope of the present invention. Because of the fact that the present invention primarily relates to a concept relative to a type of linkage it is considered that the invention can be utilized in a number of different, diverse ways for different, diverse purposes. The particular table 10 and the particular structure 50 are considered to be especially desirable because of the manner in which their constructions adapt them for their intended uses as indicated in the preceding.

We claim:

1. A folding structure including a six member Sarrus linkage having two opposed links and two sets of connecting links, each of said sets including two separate links, the connecting links of each of said sets having adjacent edges hingedly connected to one another, a first connecting link of each of said sets being hingedly connected to a first of said opposed links, the second connecting link of each of said sets being hingedly connected to the second of said opposed links, said sets of connecting links being spaced from one another, in which the improvement comprises:

a control link means pivotally connected to said second of said opposed links, a motion transmitting link means pivotally connected to said control link means and to a connecting link of one of said sets of connecting links, said control link means and said motion transmitting link means being connected to one another and to said Sarrus linkage so that said control link means may be pivoted relative to said one of said opposed links and so that such motion of said control link means will be transmitted in order to cause relative movement between said opposed links so as to move said opposed links toward one another as said structure is being folded and so as to move said opposed links away from one another as said structure is being unfolded.

2. A folding structure as claimed in claim 1 wherein:

there are two of said motion transmitting link means, one of said motion transmitting link means being connected to a connecting link of one of said sets and the other of said motion transmitting link means being connected to a corresponding connecting link of the other of said sets, said motion transmitting link means being connected to connecting links of said sets so as to move said adjacent edges the connecting links of said sets toward one another as said folding structure is being manipulated from an unfolded configuration to a folded configuration.

3. A folding structure including a six member Sarrus linkage having two opposed links and two sets of connecting links, each of said sets including two separate links, the connecting links of each of said sets having adjacent edges hingedly connected to one another, a first connecting link of each of said sets being hingedly connected to a first of said opposed links, the second connecting link of each of said sets being hingedly connected to the second of said opposed links, said sets of connecting links being spaced from one another, in which the improvement comprises:

a control link means pivotally connected to said second of said opposed links, a motion transmitting link means pivotally connected to said control link means and to a connecting link of one of said sets of connecting links, said control link means and said motion transmitting link means being connected to one another and to said Sarrus linkage so that said control link means may be pivoted relative to said one of said opposed links and so that such motion of said control link means will be transmitted in order to cause relative movement between said opposed links so as to move said opposed links toward one another as said structure is being folded and so as to move said opposed links away from one another as said structure is being unfolded, said first of said opposed links is a flat top which extends generally horizontally when said structure is in an unfolded configuration, said second of said opposed links is a brace which extends generally vertically beneath and parallel to said flat top when said structure is in said unfolded configuration, there are two of said motion transmitting link means, one of said motion transmitting link means being connected to a connecting link of one of said sets and the other of said motion transmitting link means being connected to a corresponding connecting link of the other of said sets, said motion transmitting link means being connected to connecting links of said sets so as to move said adjacent edges the connecting links of said sets toward one another as said folding structure is being manipulated from an unfolded configuration to a folded configuration, said connecting links of said sets of connecting links are located generally in the same plane when said folding structure is in said unfolded configuration, said connecting links of said sets of connecting links are hingedly connected along said adjacent edges so that said adjacent edges abut one another to limit movement of said connecting links of said sets as said folding structure is manipulated from a folded configuration to said unfolded configuration, said uppermost connecting links of said sets of connecting links are pivotally connected to said first of said opposed links so as to abut said first of said opposed links as said structure is being manipulated from a folded to said unfolded configuration so as to limit the rotation relative to said first of said connecting links, said control link means abuts against said second of said opposed links as said structure is manipulated from said folded to said unfolded configuration so as to limit rotation of said control link means relative to said second of said opposed links.

4. A folding structure as claimed in claim 3 wherein:

said folding structure is a table, said first opposed link is a table top and said second opposed link is a normally vertically extending brace, said control link means being capable of serving as a shelf when said folding structure is in said unfolded configuration.

5. A folding structure as claimed in claim 3 wherein:

said folding structure is capable of being utilized as a form of a stool which is suitable for use as a saw horse, said first opposed link is a flat top, said second opposed link is a normally vertically extending brace and said control link means is capable of serving as a step when said folding structure is in said unfolded configuration.

6. A folding structure including a six member Sarrus linkage having two opposed links and two sets of connecting links, each of said sets including two separate links, the connecting links of each of said sets having adjacent edges hingedly connected to one another, a first connecting link of each of said sets being hingedly connected to a first of said opposed links, the second connecting link of each of said sets being hingedly connected to the second of said opposed links, said sets of connecting links being spaced from one another, in which the improvement comprises:

said first of said opposed links is a flat top which extends generally horizontally when said structure is in an unfolding configuration, said second of said opposed links is a brace which extends generally vertically beneath and parallel to said flat top when said structure is in said unfolding configuration.

7. A folding structure as claimed in claim 6 including:

bracket means on said second of said opposed links, said bracket means being capable of engaging said control link as said structure is manipulated from said folded to said unfolded configuration so as to limit rotation of said control link.

8. A folding structure as claimed in claim 6 wherein:

said control link means abuts against said second of said opposed links as said structure is manipulated from said folded to said unfolded configuration so as to limit rotation of said control link means relative to said second of said opposed links.

9. A folding structure as claimed in claim 6 including:

bracket means on said second of said opposed links, said bracket means being capable of engaging said control link as said structure is manipulated from said folded to said unfolded configuration so as to limit rotation of said control link, said control link means abuts against said second of said opposed links as said structure is manipulated from said folded to said unfolded configuration so as to limit rotation of said control link means relative to said second of said opposed links.

10. A folding structure as claimed in claim 6 wherein:

there are two of said motion transmitting link means, one of said motion transmitting link means being connected to a connecting link of one of said sets and the other of said motion transmitting link means being connected to a corresponding connecting link of the other of said sets, said motion transmitting link means being connected to connecting links of said sets so as to move said adjacent edges the connecting links of said sets toward one another as said folding structure is being manipulated from an unfolded configuration to a folded configuration.

11. A folding structure as claimed in claim 6 wherein:

said connecting links of said sets of connecting links are located generally in the same plane when said folding structure is in said unfolded configuration, said connecting links of said sets of connecting links are hingedly connected along said adjacent edges so that said adjacent edges abut one another to limit movement of said connecting links of said sets as said folding structure is manipulated from a folded configuration to said unfolded configuration, said uppermost connecting links of said sets of connecting links are pivotally connected to said first of said opposed links so as to abut said first of said opposed links as said structure is being manipulated from a folded to said unfolded configuration so as to limit the rotation relative to said first of said connecting links.

12. A folding structure as claimed in claim 1 including:

bracket means on said second of said opposed links, said bracket means being capable of engaging said control link as said structure is manipulated from said folded to said unfolded configuration so as to limit rotation of said control link.

13. A folding structure as claimed in claim 1 wherein:

said control link means abuts against said second of said opposed links as said structure is manipulated from said folded to said unfolded configuration so as to limit rotation of said control link means relative to said second of said opposed links.

* * * * *